US009125481B2

(12) United States Patent
Watanabe et al.

(10) Patent No.: US 9,125,481 B2
(45) Date of Patent: Sep. 8, 2015

(54) MASSAGE BRUSH AND HANDLE FOR MASSAGE BRUSH

(75) Inventors: Toshio Watanabe, Tokyo (JP); Keiji Yoshii, Tokyo (JP)

(73) Assignee: Kao Corporation, Tokyo (JP)

( * ) Notice: Subject to any disclaimer, the term of this patent is extended or adjusted under 35 U.S.C. 154(b) by 622 days.

(21) Appl. No.: 13/496,992

(22) PCT Filed: Sep. 15, 2010

(86) PCT No.: PCT/JP2010/065915

§ 371 (c)(1),
(2), (4) Date: May 2, 2012

(87) PCT Pub. No.: WO2011/034076

PCT Pub. Date: Mar. 24, 2011

(65) Prior Publication Data

US 2012/0204369 A1 Aug. 16, 2012

(30) Foreign Application Priority Data

Sep. 17, 2009 (JP) ..... 2009-215736
May 19, 2010 (JP) ..... 2010-115699

(51) Int. Cl.
*A46B 5/02* (2006.01)
*A46B 5/00* (2006.01)
*A61H 7/00* (2006.01)

(52) U.S. Cl.
CPC ..... *A46B 5/02* (2013.01); *A46B 5/0025* (2013.01); *A61H 7/003* (2013.01);
(Continued)

(58) Field of Classification Search
CPC .. A46B 2200/1066; A46B 9/04; A46B 9/005; A46B 1/00; A46B 5/04; A46B 7/04; A46B 15/00; A46B 2200/102; A46B 5/0025; A61H 7/003
USPC ..... 15/22.1, 110, 176.1, 187, 18; 601/17, 601/137, 138
See application file for complete search history.

(56) References Cited

U.S. PATENT DOCUMENTS 1,175,249 A * 3/1916 Eisenhut ..... 15/110
2,164,219 A * 6/1939 McGerry ..... 601/141
(Continued)

FOREIGN PATENT DOCUMENTS

CN 2673371 Y 1/2005
JP 55-27422 U 2/1980
(Continued)

OTHER PUBLICATIONS

International Search Report issued on Oct. 12, 2010 in PCT/JP10/065915 filed on Sep. 15, 2010.

*Primary Examiner* — Robert Scruggs
(74) *Attorney, Agent, or Firm* — Oblon, McClelland, Maier & Neustadt, L.L.P.

(57) ABSTRACT

A massage brush (10) includes a base plate (12) that is curved in a rounded shape, a plurality of pressing protrusions (13) that protrude downward from the concave-shaped inner surface of the base plate (12), and a grip portion (20) that is connected to the center portion of the convex-shaped outer surface of the base plate (12). The base plate (12) is provided with a plurality of tongue-like sections (14) arranged at intervals in a circumferential direction and extending outward in a radial direction from the center portion of the base plate (12). The tongue-like sections protrude in a cantilever shape from base end portions (15) of the center portion by the presence of U-shaped through grooves (16) provided around the tongue-like sections other than the base end portions (15). The pressing protrusions (13) protrude downward from the tip portions of the tongue-like sections (14). A center portion pressing protrusion (17) is provided in the center portion of the base plate (12), and an auxiliary pressing protrusions is provided at an intermediate portion between adjacent pressing protrusions (13).

21 Claims, 10 Drawing Sheets

(52) U.S. Cl.
CPC ..... *A46B 2200/102* (2013.01); *A61H 7/007* (2013.01); *A61H 2201/1685* (2013.01); *A61H 2201/1692* (2013.01)

(56) References Cited

U.S. PATENT DOCUMENTS

| | | | | |
|---|---|---|---|---|
| 3,253,292 | A * | 5/1966 | Herschensohn | 15/201 |
| D253,322 | S * | 11/1979 | Saute | D4/136 |
| 7,934,284 | B2 * | 5/2011 | Braun et al. | 15/22.1 |
| 2005/0043656 | A1 | 2/2005 | Lacey | |
| 2005/0138745 | A1 * | 6/2005 | Huang | 15/187 |

FOREIGN PATENT DOCUMENTS

| | | | |
|---|---|---|---|
| JP | 59 83422 | | 6/1984 |
| JP | 61 29618 | | 2/1986 |
| JP | 2 35733 | | 3/1990 |
| JP | 3009029 | | 3/1995 |
| JP | 3041605 | U | 7/1997 |
| JP | 10 313947 | | 12/1998 |
| JP | 11-33072 | | 2/1999 |
| JP | 2000 139567 | | 5/2000 |
| JP | 2004-538117 | | 12/2004 |
| JP | 3113002 | | 9/2005 |
| JP | 2009 201570 | | 9/2009 |

* cited by examiner

MASSAGE BRUSH AND HANDLE FOR MASSAGE BRUSH

CROSS REFERENCE TO RELATED APPLICATION

This application is a 371 of PCT/JP10/065915, filed on Sep. 15, 2010, and claims priority to the following Japanese Patent Applications: 2009-215736 filed on Sep. 17, 2009; and 2010-115699, filed on May 19, 2010.

TECHNICAL FIELD

The present invention relates to a massage brush and a handle for a massage brush.

BACKGROUND ART

As a massage therapy that is executed with respect to the limbs of a body or the other parts, a pressing therapy (massage therapy of pressing the body), a strong rubbing therapy (massage therapy of rubbing the body), a kneading therapy (massage therapy of kneading the body), a light rubbing therapy (massage therapy of rubbing the body lightly), and a beating therapy (massage therapy of beating the body) are generally known. These therapies are the acting of pressing the skin of the body with fingers for compressing or rubbing skin, or applying a rotational force to the skin in order to relax the skin, so that the flow of blood is promoted, which gives rise to recovering from fatigue or prevents people from getting tired.

As devices that perform the massage, various electrically-operated massage devices or treadle type massage devices are developed. However, development of a compact device that can easily perform the massage imitating the fingers by the pressing therapy, the strong rubbing therapy, the kneading therapy, the light rubbing therapy, and the beating therapy is required.

Meanwhile, a hair brush that is known which can give a massage effect with respect to a head during hair cutting or washing in a case in which the hair brush is used while the hair is being cut or brushed (for example, refer to Patent Literature 1). The hair brush that is disclosed in Patent Literature 1 is provided with plural brush protrusions on the flat bottom surface of a bowl-shaped base plate that includes grip sections and is curved in a rounded shape. In the hair brush disclosed in Patent Literature 1, when the hair brush is manufactured using a flexible material such as elastomer or synthetic rubber, the massage effect by the brush protrusions can be improved by repeating pressing with respect to the head and releasing of the pressing, particularly, elastically deforming the base plate.

CITATION LIST

Patent Literature

Patent Literature 1: JP-U 55-27422 A

SUMMARY OF INVENTION

The present invention provides a massage brush including: a base plate; a plurality of pressing protrusions that protrude downward from an inner surface of the base plate; and a grip portion that is connected to a center portion of an outer surface of the base plate. The base plate is provided with a plurality of tongue-like sections arranged at intervals in a circumferential direction and extending from the center portion of the base plate toward the outside. The tongue-like sections protrude in a cantilever shape from base end portions of the center portion by the presence of through grooves provided around the tongue-like sections other than the base end portions. The pressing protrusions protrude downward from tip portions of the tongue-like sections.

The present invention provides a handle for a massage brush that is integrally joined to a brush body to form the massage brush. The brush body is made of a synthetic resin material having an elastic force and includes a base plate and plural pressing protrusions extending downward from the inner surface of the base plate. The handle for the massage brush has a shape in which a joining drum portion having an approximately hourglass shape where an entire circumferential surface of a cylinder becomes a constriction portion, and a grip portion protruding outward in a radial direction from an upper brim portion of the joining drum portion and extending in one direction, are integrally formed.

BRIEF DESCRIPTION OF DRAWINGS

FIG. 1(*b*) is a perspective view illustrating a brush body, when it is viewed in an obliquely downward direction.

FIG. 2(*b*) is a side view illustrating a massage brush according to a preferred embodiment of the present invention.

FIG. 2(*c*) is a bottom view illustrating a massage brush according to a preferred embodiment of the present invention.

FIG. 3(*b*) is an image diagram illustrating a massage therapy using a massage brush according to a preferred embodiment of the present invention.

FIG. 5(*b*) is a perspective view illustrating a massage situation using a massage brush according to a preferred embodiment of the present invention.

FIG. 6(*b*) is a diagram illustrating an example of various grip ways when a massage is performed using a massage brush according to a preferred embodiment of the present invention.

FIG. 6(*c*) is a diagram illustrating an example of various grip ways when a massage is performed using a massage brush according to a preferred embodiment of the present invention.

FIG. 6(*d*) is a diagram illustrating an example of various grip ways when a massage is performed using a massage brush according to a preferred embodiment of the present invention.

FIG. 6(*e*) is a diagram illustrating an example of various grip ways when a massage is performed using a massage brush according to a preferred embodiment of the present invention.

FIG. 8(*b*) is a perspective view illustrating a massage brush having another type of handle for a massage brush when the massage brush is viewed in a downward direction.

FIG. 9(*b*) is a diagram illustrating an example of various ways to grip another type of handle for a massage brush when a massage is performed.

FIG. 9(*c*) is a diagram illustrating an example of various ways to grip another type of handle for a massage brush when a massage is performed.

FIG. 9(*d*) is a diagram illustrating an example of various ways to grip another type of handle for a massage brush when a massage is performed.

FIG. 9(*e*) is a diagram illustrating an example of various ways to grip another type of handle for a massage brush when a massage is performed.

FIG. 10(*b*) is a cross-sectional view illustrating an example of another type of brush body.

FIG. 11(*b*) is a bottom view illustrating an example of another type of brush body.

FIG. 11(*c*) is a bottom view illustrating an example of another type of brush body.

DESCRIPTION OF EMBODIMENTS

However, in the hair brush that is disclosed in Patent Literature 1, brush protrusions are integrally fixed to a base plate and the deformation of the brush protrusions relative to the base plate is restricted. For this reason, a massage effect on a head skin by the brush protrusion depends on the elastically deformed volume of the base plate. As a result, it is difficult to sufficiently exert the massage effect by the pressing therapy, the strong rubbing therapy, the kneading therapy, the light rubbing therapy, and the beating therapy.

In the hair brush that is disclosed in Patent Literature 1, since the grip sections are small, it is difficult to perform an operation to obtain the massage effect. In particular, when the massage is performed with respect to the vertex or the back of the head, the hair brush needs to be operated, while an arm is raised highly.

The present invention relates to a massage brush that improves the movement of the pressing protrusions and can sufficiently exert the massage effect by the pressing therapy, the strong rubbing therapy, the kneading therapy, the light rubbing therapy, and the beating therapy.

The present invention relates to a handle for a massage brush that can perform various operations to exert the massage effect in a stable state.

The present invention provides a massage brush that includes a base plate, plural pressing protrusions that protrude downward from an inner surface of the base plate, and a grip portion that is connected to the center portion of an outer surface of the base plate. The base plate is provided with a plurality of tongue-like sections arranged at an interval therebetween in a circumferential direction and extending from the center portion of the base plate to the outside (outer edge side). The tongue-like sections protrude in a cantilever shape from base end portions of the center portion by the presence of through grooves provided around the tongue-like sections other than the base end portions. The pressing protrusions protrude downward from tip portions of the tongue-like sections.

The present invention provides a handle for a massage brush that is integrally joined to a brush body which is made of a synthetic resin material having an elastic force and includes a base plate and plural pressing protrusions that protrude downward from an inner surface of the base plate, so that a massage brush is formed. The handle for the massage brush has a shape in which a joining drum portion having an approximately hourglass shape where an entire circumferential surface of a cylinder becomes a constriction portion is integrally formed with a grip portion protruding outward in a radial direction from an upper brim portion of the joining drum portion and extending in one direction.

Figure 5A:
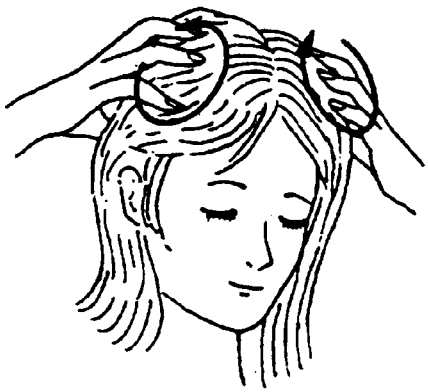
FIG. 5(*a*) is a perspective view illustrating a massage situation using the fingers of hands.
Figure 5B:
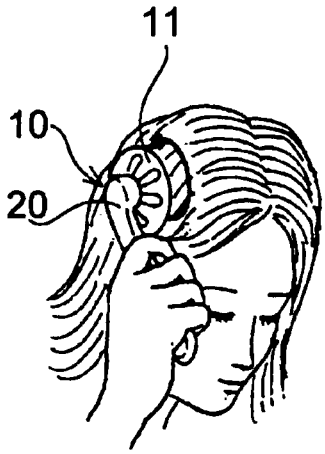
Figure 6A:
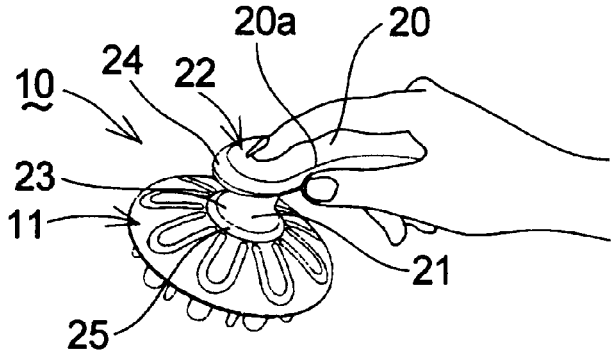
FIG. 6(*a*) is a diagram illustrating an example of various grip ways when a massage is performed using a massage brush according to a preferred embodiment of the present invention.
Figure 6B:
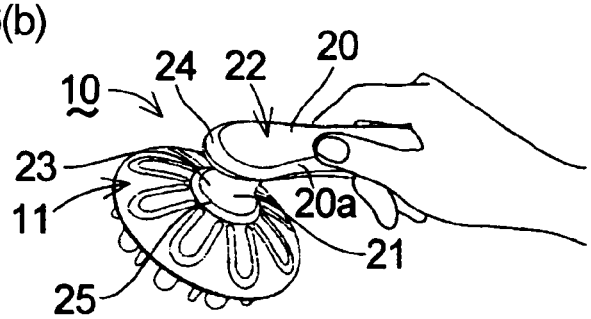
Figure 6C:
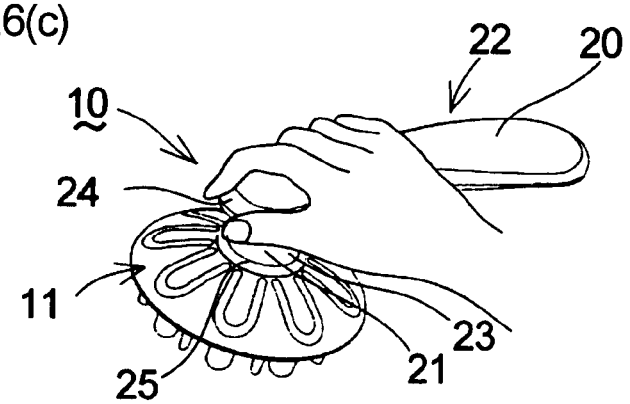
Figure 6D:
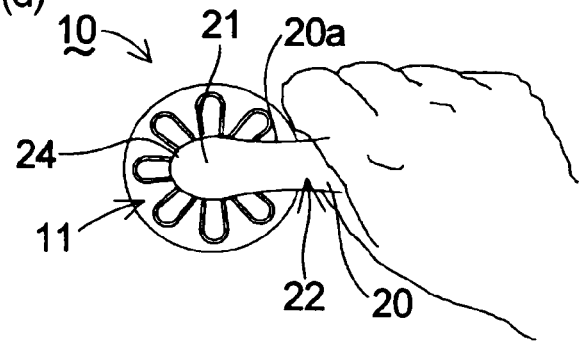
Figure 6E:
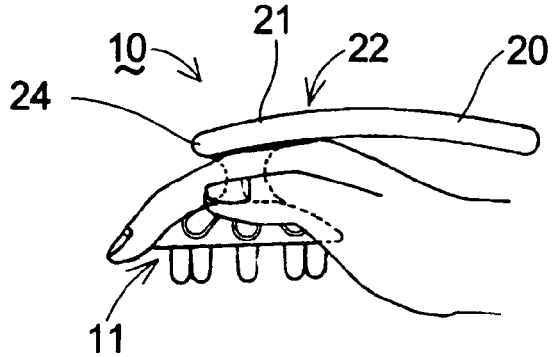

In a massage brush 10 according to a preferred embodiment of the present invention, as illustrated in FIGS. 5(*a*) and 5(*b*), the same massage effect as the case where the massage is performed using the fingers can be obtained by performing a massage using the massage brush 10 according to this embodiment (refer to FIG. 5(*b*)), instead of the massage with respect to a head by a pressing therapy, a strong rubbing therapy, a kneading therapy, a light rubbing therapy, and a beating therapy performed in a state in which a woman presses her head skin with the fingers (refer to FIG. 5(*a*)), preferably, by a simple operation performed by gripping a grip portion 20 without directly contacting a hair with the hands.

Figure 1A:
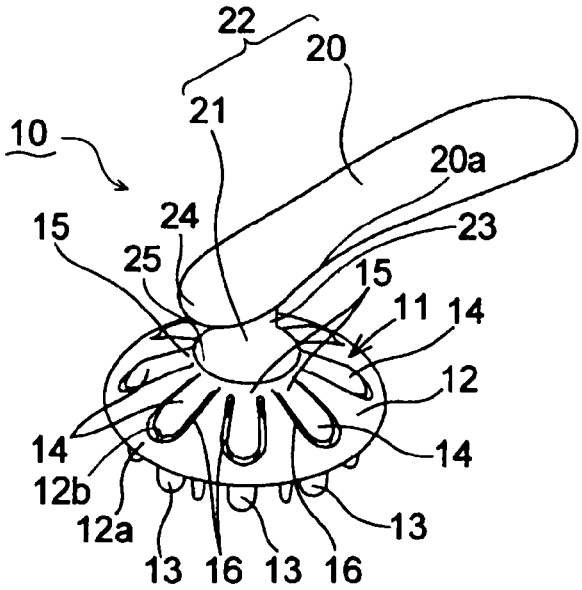
FIG. 1(*a*) is a perspective view illustrating a massage brush according to a preferred embodiment of the present invention, when it is viewed in an obliquely upward direction.
Figure 1B:
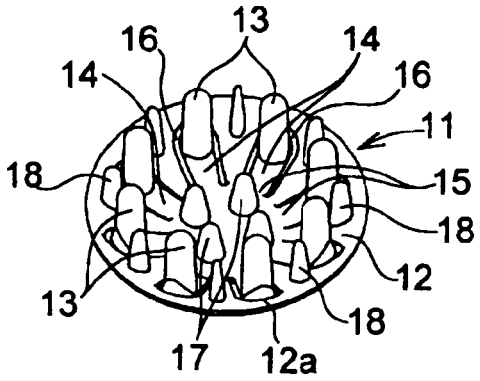

As illustrated in FIGS. 1(*a*), 1(*b*), and 2(*a*) to 2(*c*), the massage brush 10 according to this embodiment includes a base plate 12, plural pressing protrusions 13 that protrude downward from an inner surface of the base plate 12, and a grip portion 20 that is connected to the center portion of an outer surface of the base plate 12. The base plate 12 is provided with tongue-like sections 14 arranged at an interval therebetween in a circumferential direction and extending from the center portion of the base plate to the outside so as to protrude from base end portions 15 in a cantilever shape by the presence of U-shaped through grooves 16 provided around the center portion other than the base end portions 15 on the center portion side. The pressing protrusions 13 are provided so as to protrude downward from tip portions of the tongue-like sections 14.

In the massage brush 10 according to this embodiment, a center portion pressing protrusion 17 that protrudes downward is provided on an inner surface of the center portion of the base plate 12.

In the massage brush 10 according to this embodiment, an auxiliary pressing protrusion 18 that is located between the pressing protrusions 13 adjacent to each other in a circumferential direction and protrudes downward is provided on the inner surface of the base plate.

In the massage brush 10 according to this embodiment, the base plate 12 is curved in a rounded shape, the inner surface of the base plate 12 has a concave shape, the base plate 12 has a circular plate shape in a plan view, an outer surface of the base plate 12 has a convex shape, and the tongue-like sections 14 extend outward in a radial direction from the center portion of the base plate 12.

That is, in the massage brush 10 according to this embodiment, the brush body 11 integrally formed by including the base plate 12 where the tongue-like sections 14 are formed, the pressing protrusions 13, the center portion pressing protrusion 17, and the auxiliary pressing protrusions 18 and a handle 22 for a massage brush formed separately from the brush body 11 and including the grip portion 20 and the joining drum portion 21 are fixed to, for example, a fitting protrusion 12*a* (refer to FIG. 7) erected from the center portion of the outer surface of the base plate 12 having the curved shape by fitting a fitting hole 21*a* in the joining drum portion 21 provided in a lower end portion of the grip portion 20. As a result, the massage brush 10 where the brush body 11 and the handle 22 for the massage brush (grip portion 20) are integrated is formed.

In this case, the handle 22 for the massage brush that includes the grip portion 20 and the joining drum portion 21 is integrally formed using a synthetic resin material. The asynthetic resin material is harder than a material of the brush body 11, and examples of the asynthetic resin material include an acrylonitrile butadiene styrene (ABS) resin, a polybutylene terephthalate (PBT) resin, a polypropylene (PP) resin, a polyethylene (PE) resin, a polyethylene terephthalate (PET) resin, a polycyclohexanedimethylene terephthalate (PCTA) resin, a polyacetal (POM) resin, an acrylic resin, an acrylonitrile-styrene copolymer (AS) resin, and a polystyrene (PS) resin. The handle 22 for the massage brush is integrated with the brush body 11, and efficiently transmits the pressing force for pressing the pressing protrusions 13, the center portion pressing protrusion 17, or the auxiliary pressing protrusions 18 to the head skin or the rotating force for kneading the head from the grip portion 20 to the brush body 11.

The base plate 12 that constitutes the brush body 11, the pressing protrusions 13, the center portion pressing protrusion 17, and the auxiliary pressing protrusions 18 are formed using, for example, elastomer (polystyrene system, polyester system, olefin system, and urethane system) as a synthetic resin material having an elastic force where a coefficient of elasticity is about 10 to 30 Mpa. The base plate 12 has a thickness of about 2 to 7 mm, has a circular plate shape where a diameter is about 40 to 80 mm as a planar shape, and is formed in a flat bowl shape curved in a rounded shape (dome shape) with a curvature radius of about 40 to 80 mm.

As described above, in the base plate 12, the fitting protrusion 12*a* (refer to FIG. 7) that is erected from the center portion of the outer surface is provided, and the tongue-like sections 14 that extend outward in a radial direction from the center portion are provided in the eight places at an equiangular pitch of 45° at an interval therebetween in a circumferential direction. That is, each tongue-like section 14 is formed to protrude in a cantilever shape in which the tip portions having a width of about 5 to 10 mm and a length of about 12 to 20 mm are roundly formed from the base end portions 15, by the presence of the U-shaped through grooves 16 having a width of about 0.5 to 3 mm provided around the center portion other than the base end portions 15 on the center portion side of the base plate 12. In addition, the pressing protrusions 13 are provided to protrude downward from the tip portions of the tongue-like sections 14 so as to be integrated with the tip portions.

The pressing protrusion 13 is a columnar protrusion that has a pressing portion formed in a semispherical shape at the tip portion and has a diameter of about 5 to 10 mm. The pressing protrusions 13 are provided in outer circumferential portions of a lower end opening surface in the eight places, in a state in which the pressing protrusions protrude downward with the length of about 12 to 22 mm, from the lower end opening surface of the base plate 12 curved in a rounded shape.

The center portion pressing protrusion 17 is a conical protrusion that has a pressing portion formed in a semispherical shape at the tip portion. In the center portion pressing protrusion 17, the diameter of a base end portion that is an integrated portion with the base plate 12 is about 4 to 10 mm. The center portion pressing protrusions 17 are provided in the four places at the center portion of the base plate 12, preferably in a state in which the center portion pressing protrusions 17 protrude downward not to protrude from the lower end opening surface of the base plate 12 when the massage brush according to the present invention is not used, with the length shorter than the length of the pressing protrusion 13 by about 6 to 12 mm.

The auxiliary pressing protrusion 18 is a flat protrusion having a tapered shape that has a pressing portion formed in a curved shape at the tip portion. In the auxiliary pressing protrusion 18, the base end portion that is an integrated portion with the base plate 12 has an approximately oval shape where the length of a long axis is about 4 to 8 mm and the length of a short axis is about 2 to 5 mm. The auxiliary pressing protrusions 18 protrude downward from the lower end opening surface of the base plate 12 curved in a rounded shape with the length shorter than that of the protruding protrusions 13 by about 3 to 9 mm, are disposed in the portions between the pressing protrusions 13 adjacent to each other in a circumferential direction, and are provided in the eight places so as to protrude downward from the portions between the tongue-like sections 14 adjacent to each other in the circumferential direction.

Figure 3A:
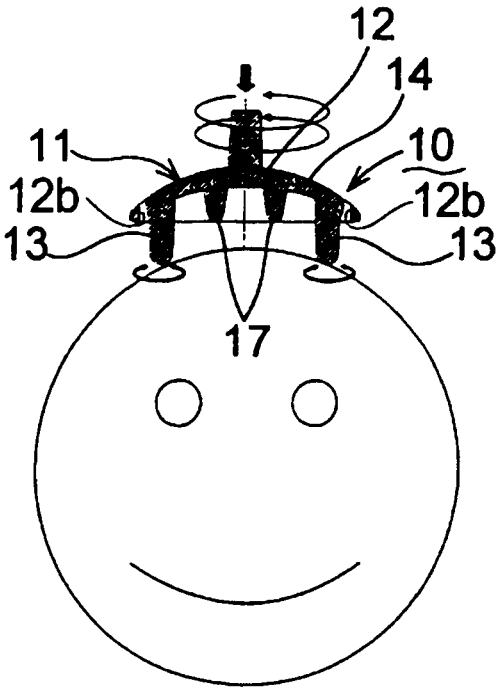
FIG. 3(*a*) is an image diagram illustrating a massage therapy using a massage brush according to a preferred embodiment of the present invention.
Figure 3B:
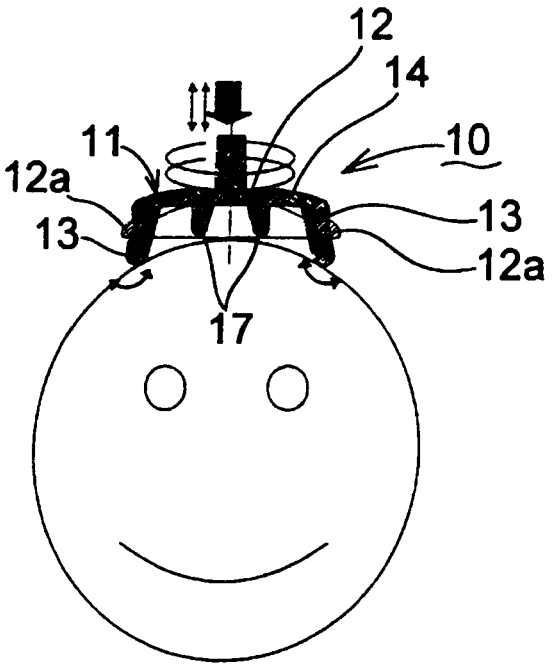

When the massage is performed with respect to the head using the massage brush 10 according to this embodiment including the above configuration, as illustrated in FIG. 3(*a*), by contacting only the longest pressing protrusion 13 with the head lightly and applying the rotating force, the massage effect that corresponds to the kneading therapy causing a feeling of moderate stimulation is obtained. In this state, if the massage brush 10 is slid along the head skin, the massage effect of the light rubbing therapy is also obtained.

If the stronger pressing force is applied from the state illustrated in FIG. 3(*a*), as illustrated in FIG. 3(*b*), the pressing protrusions 13 are deformed such that the pressing portions of the tip portions expand to the outside along the head skin, while pressing up the tip portions of the tongue-like sections 14 having the cantilever shape. For this reason, by repeating the pressing state of FIG. 3(*b*) and the releasing state of the pressing of FIG. 3(*a*), the massage effect of loosening the head skin by gripping and expanding, that is, the massage effect of the kneading therapy is obtained.

As illustrated in FIG. 3(*b*), when the pressing portions at the tip portions of the pressing protrusions 13 expand to the outside along the head skin, a part of the pressing protrusions 13 contacts the inner surface 12*b* of the circumferential portion 12*a* of the base plate 12, so that deformation to the outside is suppressed. Therefore, even though the strong pressing force is applied, the desired massage effect can be efficiently obtained without excessive deformation. If the pressing portions at the tip ends of the pressing protrusions 13 expand excessively to the outside, the massage effect by the elastic restoring force of the tongue-like sections 14 may be deteriorated.

By maintaining a state in which the pressing portions at the tip ends of the pressing protrusions 13 illustrated in FIG. 3(*b*) are expanded to the outside along the head skin, the massage effect of point pushing therapy or the pressing therapy is obtained by the elastic restoring force of the tongue-like sections 14. In this state, if the massage brush 10 is slid along the head skin, the massage effect that corresponds to the strong rubbing therapy is also obtained. By applying the rotating force in this state, the massage effect that corresponds to the kneading therapy is also obtained.

By beating and repetitively contacting the head skin with the pressing protrusions 13, the massage effect of the beating therapy is also obtained. In this case, when the pressing protrusions 13 contact the head skin, the tongue-like sections 14 are escaped upward. Therefore, the appropriate stimulus can be applied to the head skin.

If the auxiliary pressing protrusions 18 are contacted with the head skin and press the head skin while the base plate 12 curved in the rounded shape is elastically deformed by applying the pressing force to the brush body 11, the improved massage effect by the pressing therapy, strong rubbing therapy, kneading therapy, light rubbing therapy, and beating therapy can be obtained by the synergistic interaction between the pressing caused by the pressing protrusions 13 supported by the tongue-like sections 14 and the pressing caused by the auxiliary pressing protrusions 18 supported by the base plate 12.

Figure 4:
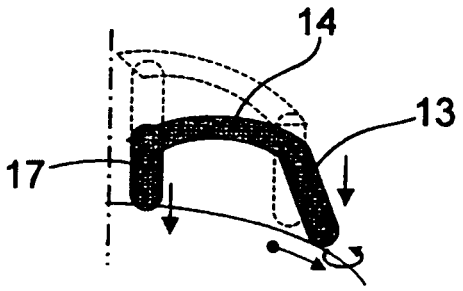
FIG. 4 is a partially cross-sectional view illustrating a massage therapy in a state in which the pressing protrusion in the center portion is pressed to a head skin.

If the center portion pressing protrusion 17 is contacted with the head skin and presses the head skin while the base plate 12 or the tongue-like sections 14 are elastically deformed by applying the strong pressing force to the brush body 11 as illustrated in FIG. 4, the massage effect of the finger pressing therapy or the point pressing therapy can be improved.

That is, with the massage brush 10 according to this embodiment, the massage effect of the pressing therapy, the strong rubbing therapy, the kneading therapy, the light rubbing therapy, and the beating therapy can be sufficiently obtained by improving the movement of the pressing protrusions 13, the auxiliary pressing protrusions 18, and the center portion pressing protrusion 17.

In this embodiment, the handle 22 for the massage brush is a handle member that is integrally joined to the brush body 11 to form the massage brush. The brush body is made of the synthetic resin material having an elastic force and includes the circular base plate 12 that is curved in the rounded shape and the plural pressing protrusions 13 that protrude downward from the concave-shaped inner surface of the base plate 12. As illustrated in FIGS. 1(*a*) and 2(*a*) to 2(*c*), the handle 22 for the massage brush has a shape in which the joining drum portion 21 having an approximately hourglass shape (approximately shell shape of a peanut or reel shape having a brim portion) where the entire circumferential surface of the cylinder becomes the constriction portion 23, and the grip portion 20 protruding outward in a radial direction from the upper brim portion 24 of the joining drum portion 21 and extending in one direction, are integrally formed.

In this embodiment, the constriction portion 23 is formed to have a cross-section of an arc shape where the curvature radius is about 8 to 30 mm, as a curved shape along the circumferential surface of the fingers of a user, and the grip portion 20 extends from the upper brim portion 24 with the width B of 18 to 40 mm and the length L of 80 to 140 mm.

The handle 22 for the massage brush that is integrally joined to the brush body 11 has the above-described shape and size. When the massage is performed with respect to the head by the massage brush 10, as illustrated in FIGS. 6(*a*) to 6(*e*), by selecting the appropriate grip way from the various grip ways according to the massage therapy such as the pressing therapy, the strong rubbing therapy, the kneading therapy, the light rubbing therapy, and the beating therapy or the massage part or the acceleration and the deceleration, the operation to obtain the massage effect is performed in a stable state and the massage can be efficiently performed.

That is, by performing the massage operation in a state in which a palm is put on the grip portion 20 to grip the grip portion, a first finger is pressed to an upper surface of the joining drum portion 21, and a thumb is pressed to a side of the grip portion 20 (FIG. 6(*a*)), the light pressing therapy or the kneading therapy can be performed. For example, by performing the massage operation in a state in which the palm is put on the grip portion 20 to grip the grip portion and the thumb is pressed to the upper surface of the grip portion 20 (FIG. 6(*b*)), the handle 22 can be gripped stably without slip and the strong rubbing therapy can be performed. For example, by performing the massage operation in a state in which a finger cushion of the thumb is pressed to the constriction portion 23 of the joining drum portion 21 and a joining portion of the grip portion 20 and the joining drum portion 21 is gripped (FIG. 6(*c*)), the strong pressing therapy or the kneading therapy can be performed. For example, by performing the massage operation in a state in which the grip portion 20 is gripped strongly (FIG. 6(*d*)), the vertex or the back of the head can be massaged using the beating therapy without raising the arms highly. For example, by performing the massage operation in a state in which the constriction portion 23 is clamped by side portions of the first finger and the middle finger, the joining drum portion 21 is interposed between the first finger and the middle finger, and the palm is put to the outer surface of the base plate 12 of the brush body 11 (FIG. 6(*e*)), the handle can be gripped to be encompassed by the palm without being affected by the length of the fingernail of the user who performs a nail art, and the pressing therapy, the light brushing therapy, and the kneading therapy can be performed tightly.

Figure 2A:
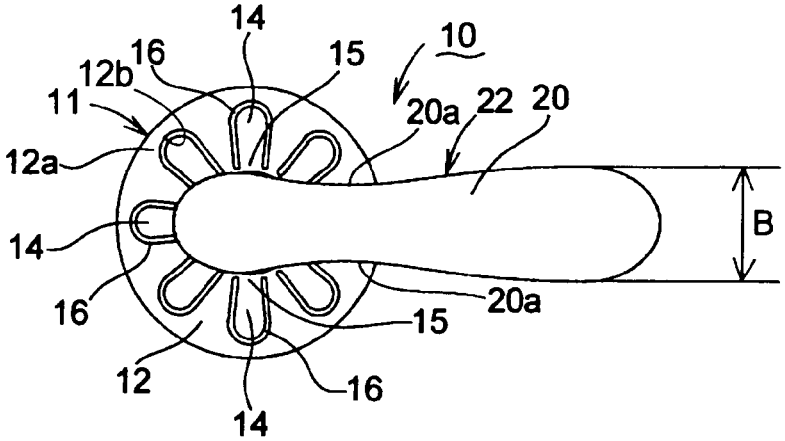
FIG. 2(*a*) is a top view (plan view) illustrating a massage brush according to a preferred embodiment of the present invention.
Figure 2B:
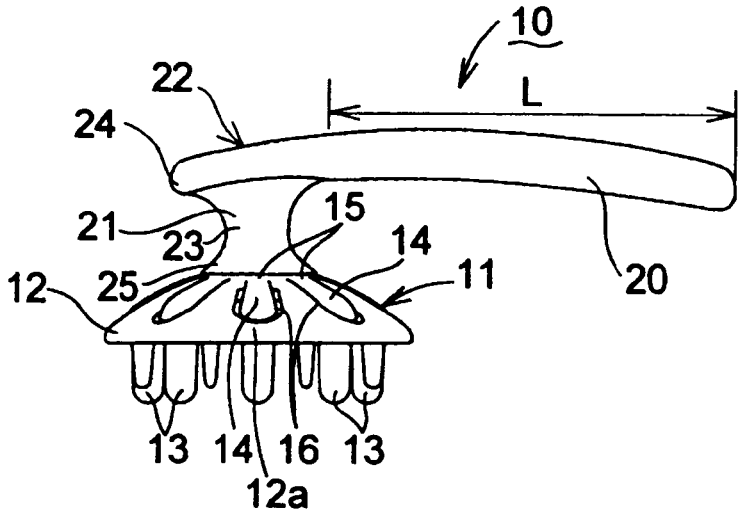
Figure 2C:
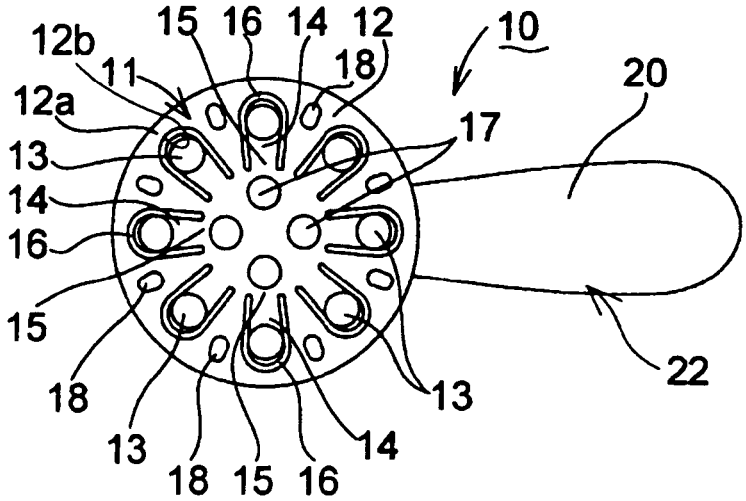

In this embodiment, the grip portion 20 has a shape in which both side edge portions are dented in a moderate curved shape when the grip portion 20 is viewed from the upper surface side (viewed two-dimensionally), as using a portion approximated to the joining drum portion 21 as a narrow portion 20*a* (refer to FIG. 2(*a*)). Thereby, easiness of gripping the grip portion 20 can be improved.

In this embodiment, the upper surface of the grip portion 20 becomes a curved convex surface (refer to FIG. 2(*b*)) where the curvature radius is 150 to 1000 mm in an extension direction and a curved convex surface where the curvature radius is 20 to 70 mm in a transverse direction perpendicular to the extension direction. Thereby, easiness of gripping the grip portion 20 can be improved.

Figure 7:
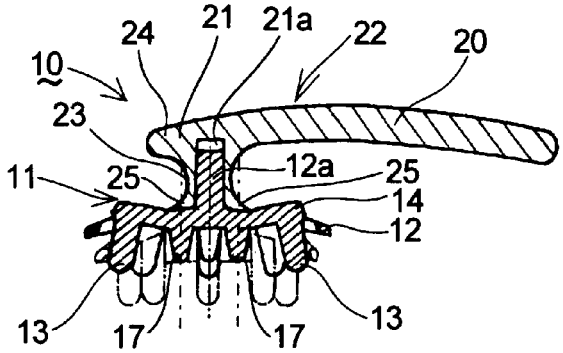
FIG. 7 is a cross-sectional view illustrating a situation where the pressing force is applied via the handle of a massage brush to bring the protrusions in the center portion into pressing contact with a head skin.

In this embodiment, as illustrated in FIG. 7, in the joining drum portion 21, the fitting hole 21*a* that opening in the center portion of the lower brim portion 25 is provided, the fitting protrusion 12*a* that is erected from the center portion of the base plate 12 of the brush body 11 is fitted into the fitting hole 21*a*, and the handle 22 for the massage brush is integrally joined to the brush body 11. Thereby, the pressing force from the handle 22 for the massage brush can be stably transmitted to the center portion of the base plate 12 coming into surface contact with the pressing area of the considerable size through the lower brim portion 25, and the massage operation can be efficiently and effectively performed. FIG. 7 is a cross-sectional view illustrating a situation where the pressing force is applied through the handle 22 for the massage brush, the center portion pressing protrusion 17 of the brush body 11 is contacted with the head skin, and the head skin is pressed by the center portion pressing protrusion 17. A two-dot chain line illustrates a cross-sectional view of the case where the pressing force is not applied and a solid line illustrates a cross-sectional view of the case where the pressing force is applied.

In particular, in this embodiment, the fitting protrusion 12*a* of the center portion of the base plate 12 of the brush body 11 is fitted into the fitting hole 21*a* opening in the center portion of the lower brim portion 25, and the lower brim portion 25 is disposed directly on a portion on the center portion pressing protrusion 17 of the brush body 11 without protruding to the base end portions 15 (refer to FIG. 1) of the tongue-like sections 14 of the brush body 11. Thereby, the diameter of the lower brim portion 25 can be prevented from excessively increasing and the elastic deformation of the base plate 12, the tongue-like section 14, or the pressing protrusion 13 can be prevented from being disturbed by the lower brim portion 25. By disposing the center portion pressing protrusion 17 in a portion directly below the lower brim portion 25, the pressing force from the handle 22 for the massage brush is easily transmitted to the center portion pressing protrusion 17 through the lower brim portion 25 and the massage effect that is obtained by pressing the center portion pressing protrusion 17 to the head skin can be efficiently obtained.

Figure 8A:
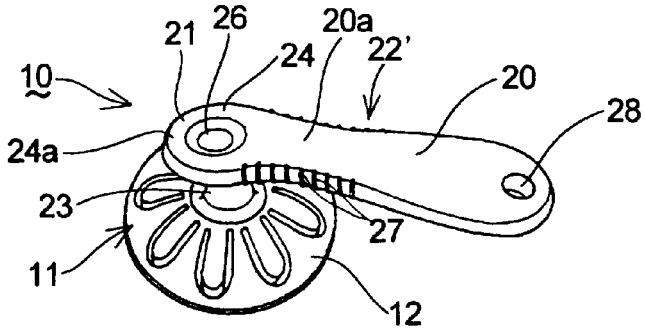
FIG. 8(*a*) is a perspective view illustrating a massage brush having another type of handle for a massage brush when it is viewed in an upward direction.
Figure 8B:
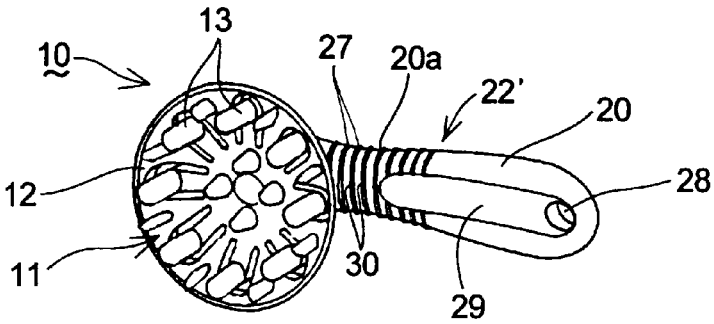
Figure 9A:
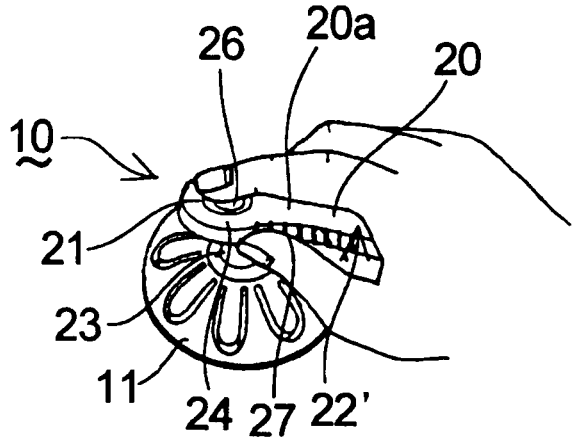
FIG. 9(*a*) is a diagram illustrating an example of various ways to grip another type of handle for a massage brush when a massage is performed.
Figure 9B:
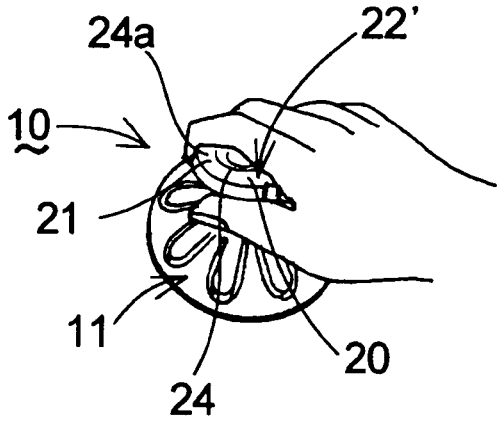
Figure 9C:
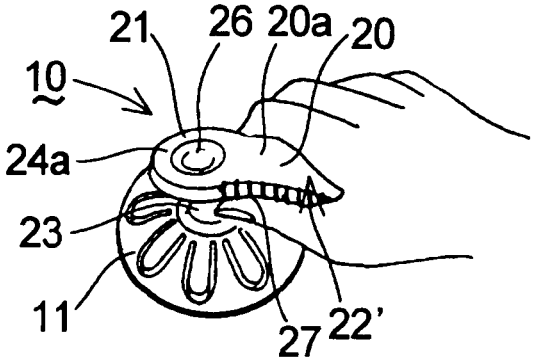
Figure 9D:
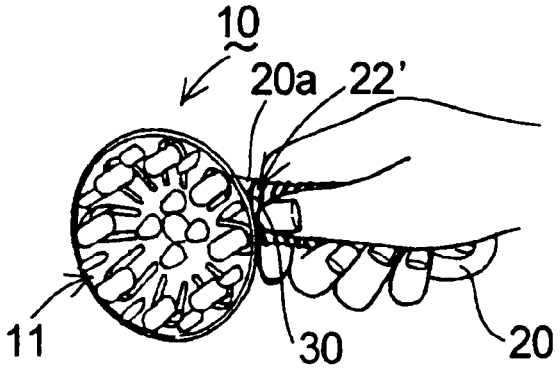
Figure 9E:
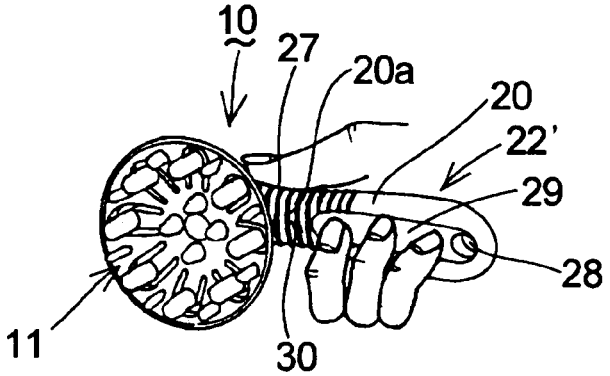

FIGS. 8(*a*) and 8(*b*) illustrate a handle 22' for another type of massage brush. Similar to the handle 22 for the massage brush, the handle 22' for the massage brush illustrated in FIGS. 8(*a*) and 8(*b*) is a handle member that is integrally joined to the brush body 11 to form the massage brush. The brush body is made of the synthetic resin material having an elastic force and includes a circular base plate 12 that is curved in a rounded shape when the base plate is viewed two-dimensionally and plural pressing protrusions 13 that protrude downward from a concave-shaped inner surface of the base plate 12. The handle 22' for the massage brush that is illustrated in FIGS. 8(*a*) and 8(*b*) has almost the same configuration as that of the handle 22 for the massage brush and has the configuration to be described below.

That is, the handle 22' for the massage brush that is illustrated in FIGS. 8(*a*) and 8(*b*) has a shape in which the joining drum portion 21 having an approximately hourglass shape where an entire circumferential surface of a cylinder becomes the constriction portion 23, and the grip portion 20 protruding outward in a radial direction from an upper brim portion 24 of the joining drum portion 21 and extending in one direction, are integrally formed. On the upper surface of the joining drum portion 21, an upper surface concave portion 26 that is bent in an elliptical shape is provided. The protruding amount of a portion 24*a* that is located at the side opposite to the grip portion 20 of the upper brim portion 24 in a diameter direction increases. On the side of the narrow portion 20*a* of the grip portion 20, plural skid-proof linear side ribs 27 are provided at an interval therebetween. In an end portion at the side that is opposite to the joining drum portion 21 of the grip portion 20, a locking hole 28 is formed such a manner as to pass through the grip portion 20.

On the back surface (bottom surface) of the grip portion 20, a back surface concave portion 29 is provided which extends from the narrow portion 20*a* to the end portion where the locking hole 28 is formed and is configured by a groove having a cross-portion of a slight arc shape. On the back surface (bottom surface) of the narrow portion 20*a* of the grip portion 20, plural skid-proof linear back surface ribs 30 are provided at an interval therebetween to be continuous to the skid-proof linear side ribs 27 of both sides.

The upper surface concave portion 26 is provided on the upper surface of the joining drum portion 21 and the linear side rib 27 is provided on the side of the narrow portion 20*a* of the grip portion 20. Thus, for example, as illustrated in FIG. 9(*a*), the massage operation can be performed in a stable state by putting the palm to the grip portion 20 to grip the grip portion, pressing the first finger to the upper surface concave portion 26 of the upper surface of the joining drum portion 21, and pressing the thumb to the side of the narrow portion 20*a* of the grip portion 20. In addition, the protruding amount of the portion 24*a* at the side opposite to the grip portion 20 of the upper brim portion 24 is increased. Thus, for example, as illustrated in FIG. 9(*b*), the massage operation can be performed in a stable state by pressing the finger cushion of the thumb to the constriction portion 23 of the joining drum portion 21 and gripping the joining portion of the grip portion 20 and the joining drum portion 21. In addition, the linear side ribs 27 are provided on both sides of the narrow portion 20*a* of the grip portion 20. Thus, for example, as illustrated in FIG. 9(*c*), the massage operation can be performed in a stable state by putting the palm to the upper surface of the grip portion 20 to grip the grip portion and interposing both sides of the narrow portion 20*a* between the thumb and the first finger.

In addition, the skid-proof linear back surface rib 30 is provided on the back surface of the narrow portion 20*a* of the grip portion 20. Thus, for example, as illustrated in FIG. 9(*d*), the massage operation can be performed in a stable state by pressing the finger cushion of the thumb to the back surface of the narrow portion 20*a* of the grip portion 20 and gripping the grip portion 20. In addition, the linear side rib 27 is provided on the side of the narrow portion 20*a* of the grip portion 20 and the back surface concave portion 29 is provided on the back surface of the grip portion 20. Thus, for example, as illustrated in FIG. 9(*e*), the massage operation can be performed in a stable state by putting the palm to the upper surface of the grip portion 20, pressing the thumb to the side of the narrow portion 20*a* of the grip portion 20, and pressing the middle finger, the annular finger, and the little finger to the back surface of the grip portion 20.

Figure 10A:
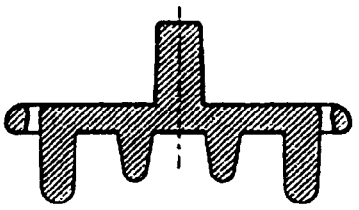
FIG. 10(*a*) is a cross-sectional view illustrating an example of another type of brush body.
Figure 10B:
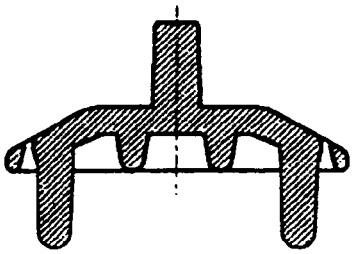

The present invention is not limited to the embodiments and various changes can be made. For example, the base plate does not need to be curved in a rounded shape and may have a flat shape as illustrated in FIG. 10(*a*) or may have a cross-section of an approximately isosceles trapezoidal shape as illustrated in FIG. 10(*b*). The inner surface of the base plate does not need to have the concave shape and the outer surface does not need to have a convex shape (FIG. 10(*a*)).

Figure 11A:
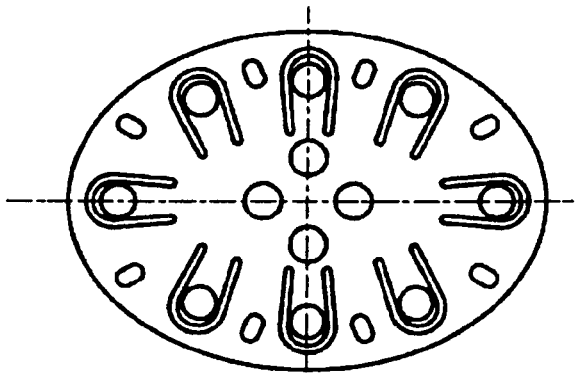
FIG. 11(*a*) is a bottom view illustrating an example of another type of brush body.
Figure 11B:
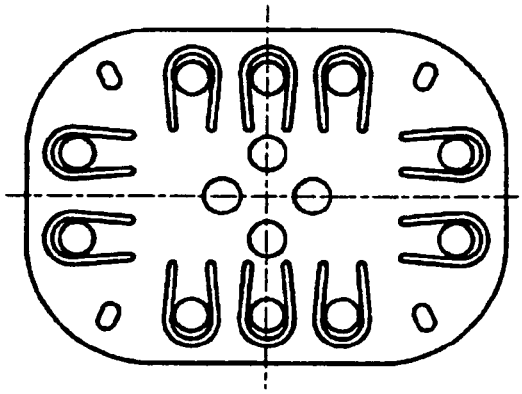
Figure 11C:
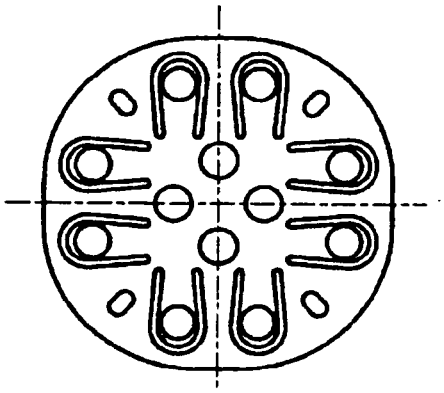

The tongue-like section does not need to extend outward in a radial direction from the center portion of the base plate. As illustrated in FIGS. 11(*a*) to 11(*c*), the tongue-like section may extend only from the center portion of the base plate to the outside. The plural tongue-like sections do not need to be provided over the entire circumference of the base plate and may be provided only in the portion along the long side of the base plate in FIG. 11(*b*). In FIG. 11(*b*), the tongue-like sections are provided in two rows along the two long sides in the upper and lower portions of the base plate. However, the tongue-like sections may be provided in one row along one long side.

For example, the center portion pressing protrusions or the auxiliary pressing protrusions do not need to be provided, and the provision places of the tongue-like sections or the pressing protrusions are not limited to the eight places and the tongue-like sections or the pressing protrusions may be provided by appropriately selecting the number thereof in view of the massage effect. The auxiliary pressing protrusions can be provided in the intermediate portions of the pressing protrusions. In addition, a hemming portion of the base plate may be decorated to improve an aesthetic quality. The massage brush according to the present invention may be used to massage the limbs of the body or the other portions, in addition to the head.

The handle for the massage brush according to the present invention may be integrally joined to various brush bodies which includes the base plate and the plural pressing protrusions extending downward from the inner surface of the base plate and made of the synthetic resin material having an elastic force, in addition to the brush body having the configuration according to the embodiment.

INDUSTRIAL APPLICABILITY

With the massage brush according to the present invention, the massage effect of the pressing therapy, the strong rubbing therapy, the kneading therapy, the light rubbing therapy, and the beating therapy can be sufficiently obtained by improving the movement of pressing protrusions.

With the handle for the massage brush according to the present invention, various operations to obtain the massage effect can be performed in a stable state.

The invention claimed is:

1. A massage brush comprising:

a base plate;

a plurality of pressing protrusions that protrude downward from an inner surface of the base plate; and a grip portion that is connected to a center portion of the base plate, at an outer surface thereof, wherein the base plate comprises a plurality of tongue sections arranged at intervals in a circumferential direction and extending outward in a radial direction from the center portion of the base plate, the tongue sections protruding in a cantilever shape from base end portions of the center portion by the presence of through grooves provided around the tongue sections other than the base end portions, the pressing protrusions protrude downward from tip portions of the tongue sections, and the massage brush is configured and operative such that when one or more of the pressing protrusions is in an expanded radially outward position, a body portion of the pressing protrusion contacts an inner surface of a circumferential portion of the base plate.

2. The massage brush according to claim 1, wherein a center portion pressing protrusion that protrudes downward is present on a portion of the inner surface corresponding to the center portion of the base plate.

3. The massage brush according to claim 1, wherein an auxiliary pressing protrusion is present between each pair of said pressing protrusions adjacent to each other in the circumferential direction, each said auxiliary pressing protrusion protruding downward and being present on the inner surface of the base plate.

4. The massage brush according to claim 3, wherein the pressing protrusions, the auxiliary pressing protrusions, and a center portion pressing protrusion that protrudes downward and that is present on a portion of the inner surface corresponding to the center portion of the base plate have different lengths.

5. The massage brush according to claim 1, wherein the base plate is curved in a rounded shape, the inner surface of the base plate has a concave shape, the base plate has a circular plate shape in a plan view, and the outer surface of the base plate has a convex shape.

6. The massage brush according to claim 1, wherein the tongue sections are radially inward of an outer circumferential portion of the base plate.

7. The massage brush according to claim 1, wherein each of the tongue sections is separated from a circumferential portion of the base plate by a portion of a corresponding through groove of said through grooves provided around the tongue sections other than the base end portions.

8. The massage brush according to claim 1, wherein each of the pressing protrusions is a columnar protrusion having a hemispherical tip portion.

9. The massage brush according to claim 1, wherein each of the through grooves is surrounded on all sides by the base plate.

10. The massage brush according to claim 1, wherein the through grooves provided around the tongue sections are all the same shape.

11. The massage brush according to claim 1, wherein the base plate has a circular shape in a plan view.

12. The massage brush according to claim 1, wherein the intervals in the circumferential direction at which the tongue sections are arranged are uniform.

13. The massage brush according to claim 1, further comprising a handle that is integrally joined to the base plate, the handle having a shape in which a joining drum portion having an approximately hourglass shape where an entire circumferential surface of a cylinder becomes a constriction portion, and a grip portion protruding outward in a radial direction from an upper brim portion of the joining drum portion and extending in one direction, are integrally formed.

14. A handle for a massage brush that is integrally joined to a brush body to form the massage brush, the brush body being made of a synthetic resin material having an elastic force, and comprising a base plate and a plurality of pressing protrusions that protrude downward from an inner surface of the base plate, the base plate including a plurality of tongue sections arranged at intervals in a circumferential direction and extending outward in a radial direction from a center portion of the base plate, the tongue sections protruding in a cantilever shape from base end portions of the center portion by the presence of through grooves provided around the tongue sections other than the base end portions, wherein the handle for the massage brush has a shape in which a joining drum portion having an approximately hourglass shape where an entire circumferential surface of a cylinder becomes a constriction portion, and a grip portion protruding outward in a radial direction from an upper brim portion of the joining drum portion and extending in one direction, are integrally formed, and the massage brush is configured and operative such that when one or more of the pressing protrusions is in an expanded radially outward position, a body portion of the pressing protrusion contacts an inner surface of a circumferential portion of the base plate.

15. The handle for a massage brush according to claim 14, wherein the constriction portion has a curved shape conforming along a circumferential surface of fingers of a user and the grip portion extends from the upper brim portion with a width of 18 to 40 mm and a length of 80 to 140 mm.

16. The handle for a massage brush according to claim 14, wherein the joining drum portion is provided with a fitting hole opening in a center portion of a lower brim portion, a fitting protrusion that is erected from the center portion of the base plate of the brush body is fitted into the fitting hole, and the handle for the massage brush is integrally joined to the brush body.

17. The handle for the massage brush according to claim 14, wherein an upper surface of the grip portion is a curved convex surface with a curvature radius of 150 to 1000 mm in an extension direction and is a curved convex surface with a curvature radius of 20 to 70 mm in a transverse direction perpendicular to the extension direction.

18. The handle for a massage brush according to claim 14, wherein the joining drum portion and the grip portion are formed in one piece.

19. The handle for a massage brush according to claim 14, wherein the joining drum portion and grip portion are formed of a same material.

20. The handle for a massage brush according to claim 14, wherein the grip portion protrudes outward in the radial direction such that a free end of the grip portion extends past a perimeter of the base plate in a plan view.

21. The handle for a massage brush according to claim 14, wherein the joining drum has a fitting hole opening that extends into the constriction portion of the joining drum.

* * * * *